US005947282A

United States Patent [19]

Merrill et al.

[11] Patent Number: 5,947,282

[45] Date of Patent: Sep. 7, 1999

[54] GOLF CLUB ORGANIZER FOR A GOLF BAG

[75] Inventors: Christopher A. Merrill, Sugar Hill; Wayne I. Schmitt, Jr., Lilburn, both of Ga.

[73] Assignee: Mizuno USA, Inc., Norcross, Ga.

[21] Appl. No.: 09/014,746

[22] Filed: Jan. 28, 1998

[51] Int. Cl.[6] ..... A63B 55/00; A63B 57/00; B65D 85/00

[52] U.S. Cl. ..... 206/315.6; 206/315.3; 206/523; 206/591

[58] Field of Search ..... 206/315.2–315.6, 206/523, 591

[56] References Cited

U.S. PATENT DOCUMENTS

| | | | |
|---|---|---|---|
| 1,409,323 | 3/1922 | Wells | 206/315.5 |
| 1,570,500 | 1/1926 | Kennedy | 206/315.6 |
| 1,756,902 | 4/1930 | Boyce . | |
| 2,521,573 | 9/1950 | Filler et al. | 206/315.3 |
| 2,551,780 | 5/1951 | Wood | 206/315.6 X |
| 2,879,819 | 3/1959 | Turnbull | 206/315.4 |
| 3,139,132 | 6/1964 | Shiller | 206/315.6 |
| 4,174,747 | 11/1979 | Boles | 206/315.6 |
| 4,181,167 | 1/1980 | Ret | 206/315.6 |
| 4,241,774 | 12/1980 | Pell | 206/315.6 |
| 4,673,082 | 6/1987 | Hemme | 206/315.6 |
| 4,753,446 | 6/1988 | Mills | 280/47.18 |
| 4,852,896 | 8/1989 | Mills | 280/47.18 |
| 5,029,703 | 7/1991 | Dulyea, Sr. | 206/315.3 |
| 5,222,596 | 6/1993 | Jordan | 206/315.6 |
| 5,279,414 | 1/1994 | Brasher | 206/315.6 |
| 5,366,075 | 11/1994 | Mills | 206/315.6 |
| 5,421,454 | 6/1995 | Chern | 206/315.6 |
| 5,617,951 | 4/1997 | Wick | 206/315.6 |
| 5,620,091 | 4/1997 | Larson | 206/315.6 |
| 5,634,557 | 6/1997 | Shin et al. | 206/315.6 |
| 5,636,734 | 6/1997 | Smith | 206/315.2 |
| 5,645,166 | 7/1997 | Su | 206/315.6 |

*Primary Examiner*—Sue A. Weaver
*Attorney, Agent, or Firm*—Troutman Sanders LLP; Gerald R. Ross, Esq.

[57] ABSTRACT

A novel golf club organizer for a golf bag is disclosed. The golf club organizer includes a resilient, lightweight golf club shaft retaining ring disposed within the golf club receiving opening of a golf bag and a base member mounted within the bottom of the golf bag to restrict the motion of the golf clubs, thereby preventing the golf clubs from becoming entangled.

21 Claims, 3 Drawing Sheets

GOLF CLUB ORGANIZER FOR A GOLF BAG

BACKGROUND OF THE INVENTION

1. Technical Field

This invention relates generally to a golf club organizer for a golf bag. Particularly, this invention relates to a golf club organizer for a golf bag including a resilient shaft retaining ring disposed within the golf club receiving opening of a golf bag and a base member mounted within the bottom of the golf bag to restrict the motion of the golf clubs, thereby preventing the golf clubs from becoming damaged or entangled.

2. Description of the Prior Art

Standard golf bags have a large golf club receiving opening into which the golfer inserts his or her golf clubs. Typically, this golf club receiving opening has crossbars which divide the opening into three or six compartments to provide some measure of organization to the clubs. However, since a golfer typically has in excess of a dozen clubs, this arrangement requires that several clubs be stored in each compartment. This can lead to difficulty in finding a particular club, especially when dealing with clubs which have a similar size and shape. Another problem with this arrangement is that it allows clubs to move freely in the opening of the bag and become entangled. Furthermore, when jostled, the clubs are free to strike one another, which can damage the (typically expensive) golf clubs.

One means of addressing these problems has been to position a golf club engaging ring to support the shafts of the golf clubs in fixed positions about the periphery of the club receiving opening of the golf bag.

For example, U.S. Pat. No. 5,222,596 to Jordan and U.S. Pat. No. 5,645,166 to Su each disclose golf club shaft retaining rings disposed about the club receiving opening of a golf bag with thin projecting fingers to releasably engage the golf club shafts. However, with repeated use these thin fingers are likely to deform and break, unnecessarily limiting the life of the golf club organizer.

Another approach to the problem of restraining the golf clubs at the top of a golf bag is exemplified by U.S. Pat. No. 1,756,902 to Boyce, U.S. Pat. No. 2,551,780 to Wood, U.S. Pat. No. 4,181,167 to Ret and U.S. Pat. No. 5,029,703 to Dulyea. Each of these devices includes a shaft retaining ring disposed about the periphery of the club receiving opening of a golf bag including relatively thick fingers composed of a resilient material. In each of these designs, adjacent fingers define club receiving chambers to frictionally hold a golf club shaft in position. Each of the devices disclosed in these references provides only a relatively short slot with only a short narrow portion for retaining the club shafts. Accordingly, as the golf bag is jostled, especially when the bag is carried, the club shafts may become dislodged.

Additionally, regardless of the method used to organize and protect the golf clubs at the top of a golf bag, damage and entanglement of the golf club shafts may still occur in the bottom portion of the golf bag. An approach to solving this problem has been to include a club organizing base member in the bottom portion of the golf bag.

The most secure way to hold the clubs in fixed positions in the bottom of a golf bag has been to include of a base member with individual holes for retaining the shafts of each individual golf club, as exemplified by U.S. Pat. No. 4,181,167 to Ret and U.S. Pat. No. 4,852,896 to Mills. However, this design makes insertion of clubs into the club organizer difficult since the golfer must, from a distance, manipulate each club into a small hole located in the bottom portion of the golf bag. Additionally, if other clubs are present in the bag or the lighting is poor, it may be difficult to see the holes, making club insertion even more difficult.

Another approach used to provide some organization and restraint to golf club shafts in the bottom of a golf bag has been to include a central base member to form a club receiving channel between the base member and the walls of the golf bag.

For example U.S. Pat. No. 2,551,780 to Wood describes a conical base member disposed in the flared bottom of a golf bag for restraining the head portions of golf clubs. The conical slope is adapted to hold the heads of golf clubs within the flared bottom portion of the bag, which prevents undue movement of the clubs when the bag is moved or jostled. However, this design is not well adapted to secure the clubs when they are inserted grip end down, since the clubs may move relatively easily up the conical slope and strike one another when the bag is moved or jostled.

Similarly, U.S. Pat. No. 5,222,596 to Jordan discloses a base member having a channel and having a flat or arcuate upper surface, and U.S. Pat. No. 5,029,703 to Dulyea, Sr. discloses a base member with scalloped openings adapted to receive the shafts of individual golf clubs. However, neither of these devices results in secure restraint of the golf club shafts when the bag is moved or jostled.

Several of the previously discussed inventions include both a shaft retaining ring and a base member to restrain the golf clubs in both the top and bottom portions of the golf bag. However, none of these inventions optimizes restraint of golf clubs and ease of club insertion while ensuring long term usefulness and durability.

SUMMARY OF THE INVENTION

The present invention recognizes and addresses the above-discussed shortcomings and needs, as well as others. In accordance with the teachings of the present invention, a novel golf club organizer for a golf bag is disclosed.

More specifically, the present invention comprises a golf club organizer for a golf bag including a resilient shaft retaining ring disposed within the club receiving opening of a golf bag and a base member mounted within the bottom of the golf bag to restrict the motion of the golf clubs, thereby preventing the golf clubs from becoming entangled.

In a preferred embodiment of the present invention, the shaft retaining ring is composed of a unitary, resilient, lightweight material and is disposed about the periphery of the club receiving opening of the golf bag. The shaft retaining ring has a plurality of thick fingers projecting inwardly from its inner periphery. The edges of the upper portion of adjacent fingers define a series of long shaft receiving slots. The lower portion of each of the fingers further has an indentation which together with the lower portion of an adjacent finger defines a shaft receiving chamber located at the base of each shaft receiving slot. Due to their thick, sturdy construction, the fingers are more durable than those disclosed in prior golf club organizers.

The width of the shaft receiving slots is less than the diameter of a golf club shaft. Due to the resilient nature of the material from which the fingers and walls of the shaft receiving slot are constructed, a golf club shaft may be passed through a shaft receiving slot into the associated shaft receiving chamber. The golf club shaft is then retained in the shaft receiving chamber until the golf club shaft is forcibly removed by the golfer.

The long, narrow shaft receiving slot of the present invention provides for more secure restraint of the golf club shaft than that provided by prior art resilient shaft retaining rings. Furthermore, the configuration of the shaft retaining ring allows the golf clubs to be maintained in a specific order chosen by the golfer, and thereby makes it easier for the golfer to find a particular golf club.

The golf club organizer optionally includes a travel insert for additional stability. The travel insert provides additional stability to the golf clubs during transport maintains the golf clubs within their appropriate shaft receiving slots even under heavy shocks or when the golf bag is not in a vertical orientation.

The golf club organizer also includes a base member mounted at the bottom of the golf bag to restrain the golf club shafts, preventing them from striking one another or becoming entangled in the bottom of the golf bag. The base member extends upward from the bottom of the golf bag and has a bottom portion with steeply sloped walls defining a golf club receiving channel between their edge and the inner walls of the golf bag. The base member also has a top portion, the side walls of which are less steeply sloped in a pyramidal or faceted manner to guide golf clubs into the golf club receiving channel, thereby enhancing the ease with which golf clubs may be inserted into the golf club organizer.

DETAILED DESCRIPTION OF THE INVENTION

Figure 1:
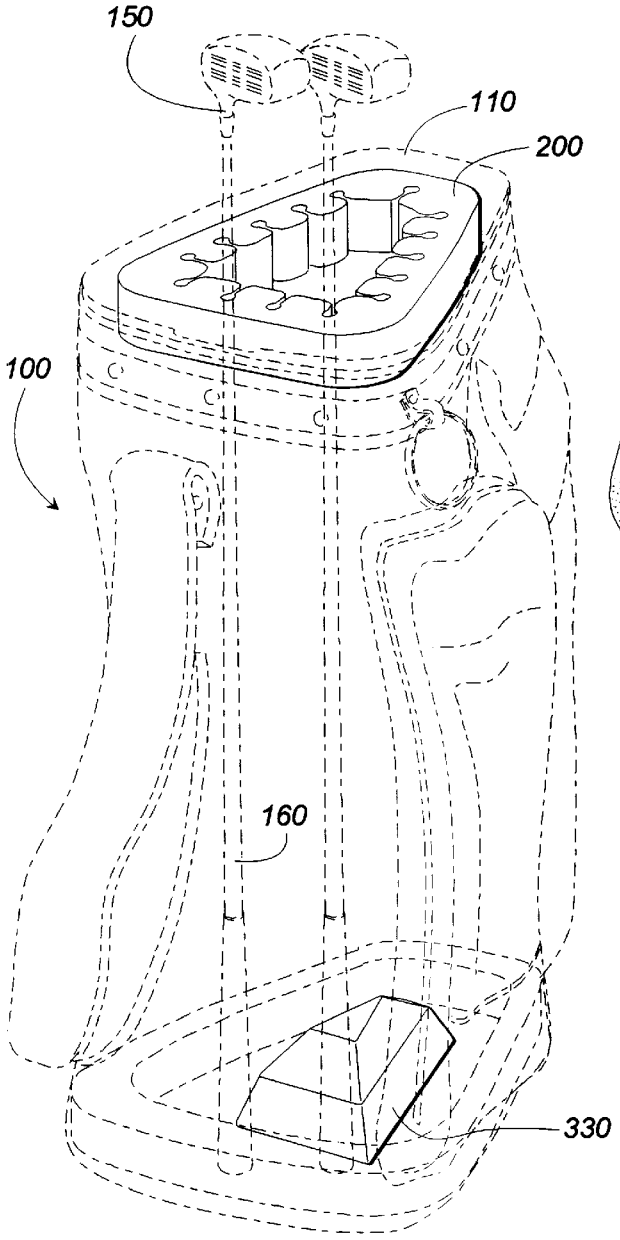
FIG. 1 depicts a perspective cut-through view of a preferred embodiment of the golf club organizer mounted in a golf bag.

Referring to FIG. 1, in a preferred embodiment, the golf club organizer includes a shaft retaining ring 200 disposed about the periphery of the golf club receiving opening 110 of a golf bag 100 and a base member 300 disposed at the bottom of the golf bag 100 for preventing entanglement of the golf club shafts 160.

In a presently preferred embodiment, the shaft retaining ring 200 is adapted to fit into the club receiving opening 110 of the golf bag 100 and includes projecting fingers 210 to releasably engage the shafts 160 of golf clubs.

Figure 2:
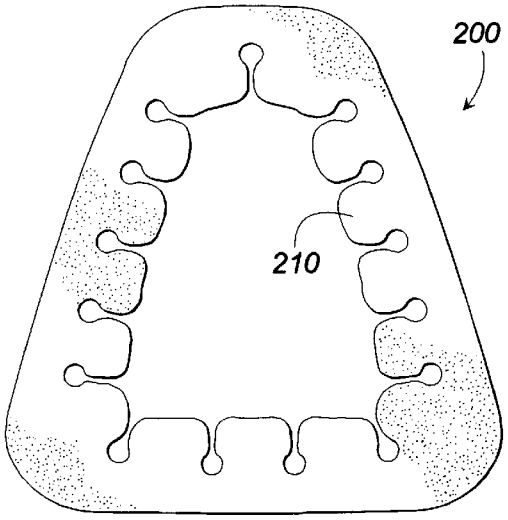
FIGS. 2 and 2A depicts a top view of the golf club shaft retaining ring of the golf club organizer.
Figure 2A:
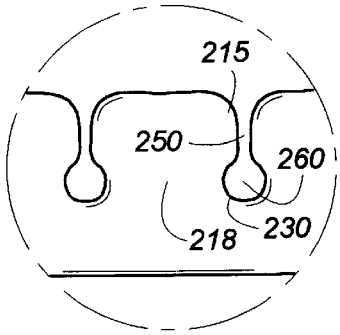

Referring now to FIG. 2, the shaft retaining ring 200 is preferably constructed from a unitary, resilient, light-weight material such as foam rubber, rubber, styrofoam or a light-weight plastic. The unitary construction of the shaft retaining ring 200 allows for easy and affordable manufacturing by conventional injection molding or foam cutting means. It is important that the material from which the shaft retaining ring is constructed be lightweight in order to reduce the overall weight of the golf bag and increase golfer comfort.

The shaft retaining ring 200 has a plurality of thick fingers 210 projecting inwardly from its inner periphery for engaging the shafts of the golf clubs 150. Each finger 210 has an upper portion 215 and a lower portion 218.

The bottom portion 218 of each of the fingers 210 also has an indentation 230 near its base. The lower portions 218 of two adjacent fingers 210 are unitarily combined to form a shaft receiving chamber 260. In the preferred embodiment, the shaft receiving chamber 260 has a generally circular cross section The upper portion 215 of each of the adjacent fingers 210 extends inwardly to define a shaft receiving slot 250 extending inwardly from the respective shaft receiving chamber 260. In the preferred embodiment, the shaft receiving slot 250 has a length longer than the diameter of the shaft receiving chamber 260 and greater than one half inch.

Substantially along its entire length, shaft receiving slot 250 has a width considerably less than the diameter of a typical golf club shaft 160. In the preferred embodiment the width of the shaft receiving slot is less than 80' the diameter of a typical golf club shaft. Due to the resilient nature of the material from which the fingers 210 are constructed, a golf club shaft 160 may be forcibly passed through a shaft receiving slot 250 into the shaft receiving chamber 260 located at the bottom of the shaft receiving slot 250. The golf club shaft 160 may then be retained in the shaft receiving chamber 260 until forcibly removed by the golfer.

Each of the fingers 210 is preferably thick and sturdy, extending at least as far laterally as it extends inwardly from the inner periphery of shaft retaining ring 210. Due to this thick, sturdy construction, the fingers 210 are more durable than those disclosed in prior golf club organizers.

The configuration of the shaft retaining ring 200 allows the golfer to position golf clubs 150 a specific pattern of his choice, preferably based on the numerical designation of the golf club 150. By maintaining the golf clubs 150 in specific positions, the shaft retaining ring 200 makes it easier for a golfer to find a particular golf club 150.

Figure 3:
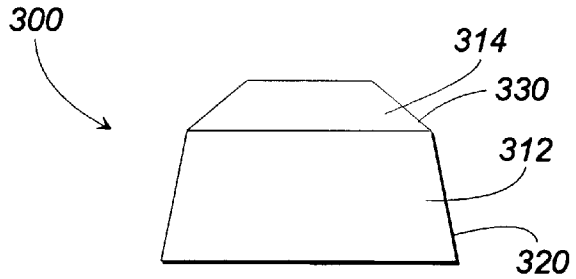
FIG. 3 depicts a side view of the golf bag base member of the golf club organizer.
Figure 4:
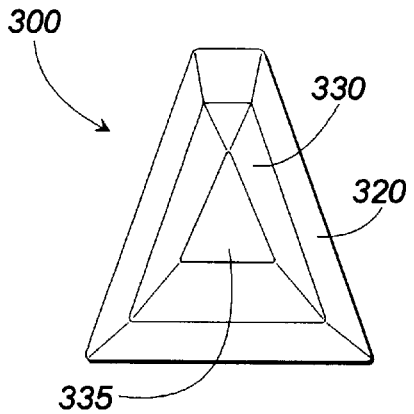
FIG. 4 depicts a top view of the golf bag base member of the golf club organizer.
Figure 5:
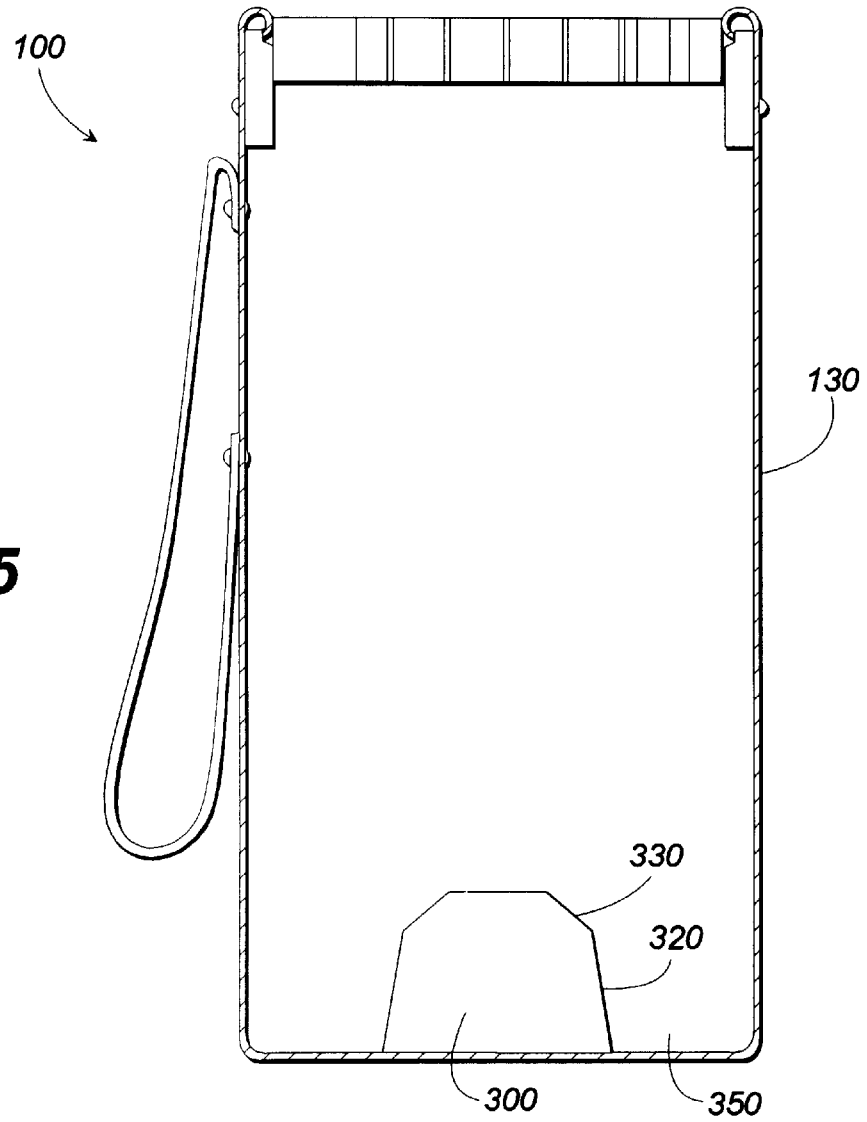
FIG. 5 depicts a cross-sectional view of the golf club organizer mounted in a golf bag.

Referring now to FIG. 3–5, the golf club organizer also includes a base member 300 mounted at the bottom of the interior cavity of the golf bag 100 to restrain the golf clubs 150, preventing them from striking one another or becoming entangled in the bottom of the golf bag 100. The base member 300 extends upward from the central region of the bottom of the golf bag 100 and has a top portion 314 and a bottom portion 312.

The bottom portion 312 of base member 300 has at least three side walls 320 which extend upwardly and inwardly at a steep angle to define a golf club receiving channel 350 between their edge and the inner walls 130 of the golf bag. The top portion 314 of base member 300 has at least three side walls 330 which extend inwardly and upwardly at an angle less than that of the bottom portion side walls 320, thereby providing a means for guiding the golf club shafts 160 into the golf club receiving channel 350 and enhancing the ease with which golf clubs 150 may be inserted into the golf club organizer. In the preferred embodiment, the side walls 320 of the bottom portion 312 of base member 300 extend at least three inches from the base of the golf bag.

The side walls 320 of bottom portion 312 of base member 300 and the side walls 330 of top portion 314 of base member 300 are arranged in a pyramidal or faceted manner, including three or more sides. The side walls 330 of the top portion 314 of base member 300 may come together to a point or may terminate at a planar surface 335.

The base member 300 is preferably constructed from a lightweight material such as foam rubber, rubber, styrofoam or a light-weight plastic, to minimize the weight of the golf bag 100 and enhance golfer comfort while carrying the bag. The base member 300 may either be attached to the bottom of the golf bag club receiving cavity, or may be formed as an integral portion of the bottom section of the golf bag 100.

Figure 6:
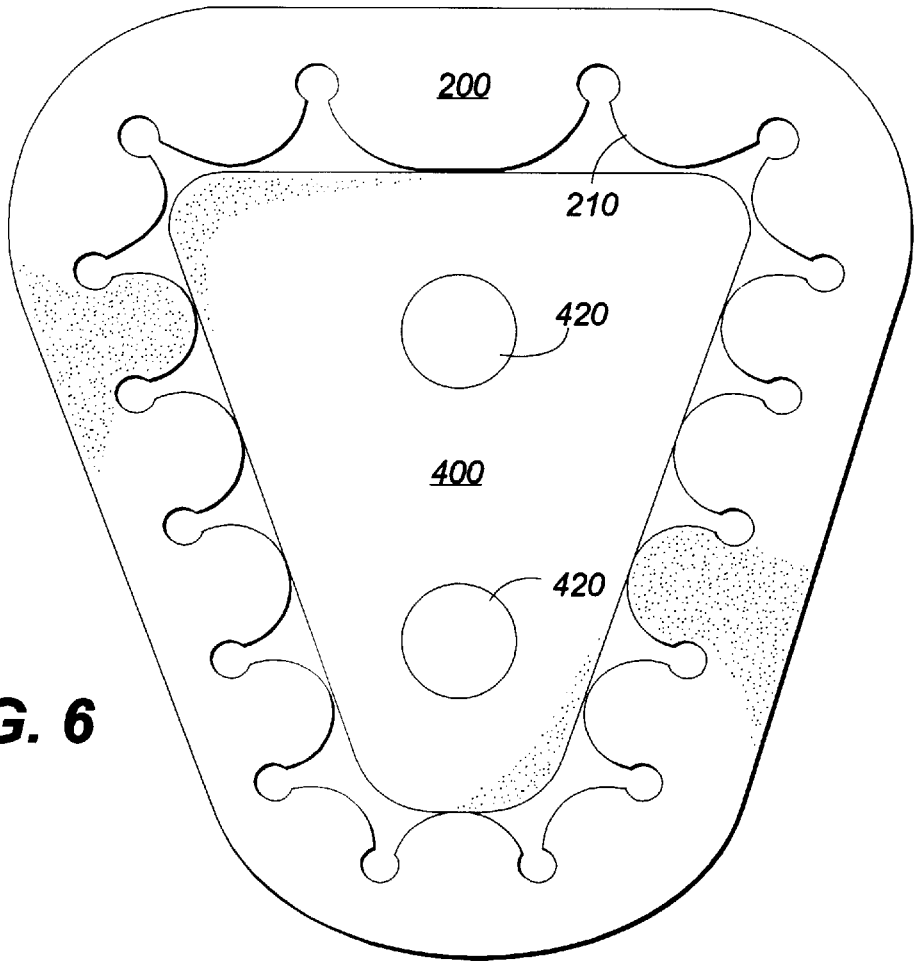
FIG. 6 depicts a top view of the travel insert and shaft retaining ring of the golf club organizer.
Figure 7:
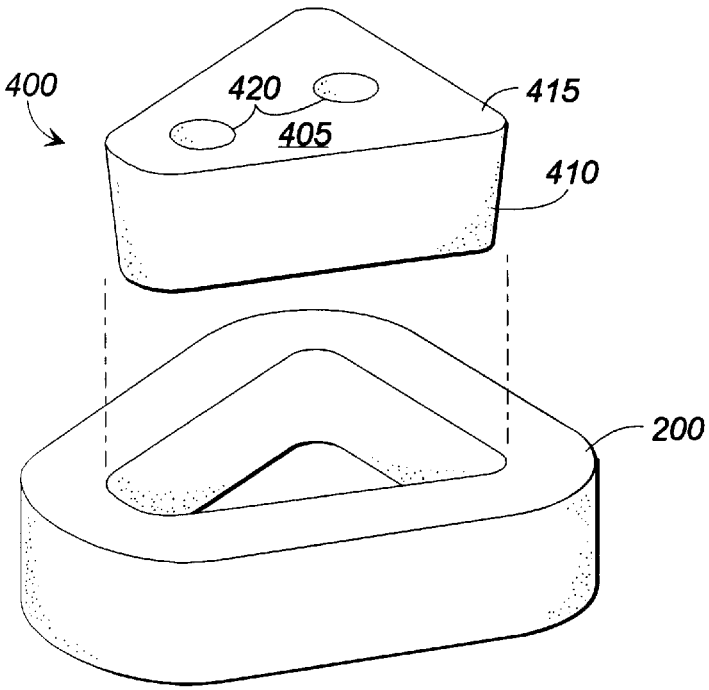
FIG. 7 depicts a perspective view of the travel insert and shaft retaining ring of the golf club organizer.

Referring now to FIG. 6 and FIG. 7, the golf club organizer may optionally include a travel insert 400. In a preferred embodiment, the travel insert 400 consists of a block member 405 constructed from a lightweight resilient material and shaped to be fit snugly into the inner opening of shaft retaining ring 200. In the preferred embodiment, the peripheral edge 410 of travel insert 400 is slightly tapered to ensure a snug fit within shaft retaining ring 200 and to prevent the travel insert 400 from falling into the interior of the golf bag 100. Additionally, in a further preferred embodiment, finger holes 420 may be provided in upper surface 415 of travel insert 400 to allow the golfer to firmly and easily grip the travel insert 400 for removal.

When inserted into the shaft retaining ring 200, the travel insert 400 provides additional stabilization and protection for the clubs 150, maintaining the golf clubs 150 in their appropriate shaft receiving slots 250 even under heavy shock or when the golf bag 100 is in a non-vertical orientation.

What have been described above are preferred embodiments of the present invention. It is, of course, not possible to describe every conceivable combination of methodologies for purposes of describing the present invention. However, one of ordinary skill in the art will recognize that many further combinations, permutations and modifications of the present invention are possible. Therefore, all such possible combinations, permutations and modifications are to be included within the scope of the claimed invention, as defined by the claims below.

What is claimed is:

1. A golf club organizer for a golf bag comprising:

a retaining ring disposed about the inner periphery of the club receiving opening of the golf bag, said retaining ring having first and second adjacent fingers projecting inwardly therefrom for engaging the shaft of a golf club, said first and second adjacent fingers each having an upper portion and a lower portion;

wherein said lower portion of said first and second adjacent fingers each includes an indentation, and wherein said lower portion of said first and second adjacent fingers are unitarily combined to form a shaft receiving chamber from said indentations;

wherein said upper portions of said first and second adjacent fingers each extend inwardly from said shaft receiving chamber formed from said lower portion of each respective finger to define a shaft receiving slot;

wherein the length of said shaft receiving slot is greater than the diameter of said shaft receiving chamber; and a base member disposed at the bottom of a golf bag for preventing entanglement of the golf clubs, wherein said base member defines a golf club receiving channel between the outer edges of said base member and the inner walls of the golf bag and wherein said base member is pyramidal in shape including a plurality of side walls extending upwardly from the bottom of the golf bag and inwardly at an angle.

2. The golf club organizer for a golf bag of claim 1, wherein said retaining ring is constructed from a resilient material.

3. The golf club organizer for a golf bag of claim 1, wherein said retaining ring is constructed from a unitary material.

4. The golf club organizer for a golf bag of claim 1, wherein said golf club shaft retaining ring is constructed from a material selected from the group consisting of: rubber, foam rubber, styrofoam, and lightweight plastic.

5. The golf club organizer for a golf bag of claim 1, wherein said shaft receiving slot is greater than one-half inch in length.

6. The golf club organizer for a golf bag of claim 1, wherein each of said first and second adjacent fingers extends at least as far laterally as it extends inwardly from the inner periphery of the golf club shaft retaining ring.

7. The golf club organizer for a golf bag of claim 1, wherein said shaft receiving slot has a width less than that of a golf club shaft for locking the golf club shaft into said shaft receiving chamber after insertion.

8. A golf club organizer for a golf bag comprising:

a retaining ring disposed about the inner periphery of the club receiving opening of the golf bag, said retaining ring having first and second adjacent fingers projecting inwardly therefrom for engaging the shaft of a golf club, said first and second adjacent fingers each having an upper portion and a lower portion;

wherein said lower portion of said first and second adjacent fingers each includes an indentation, and wherein said lower portion of said first and second adjacent fingers are unitarily combined to form a shaft receiving chamber from said indentations;

wherein said upper portions of said first and second adjacent fingers each extend inwardly from said shaft receiving chamber formed from said lower portion of each respective finger to define a shaft receiving slot;

wherein the length of said shaft receiving slot is greater than the diameter of said shaft receiving chamber; and a base member disposed at the bottom of a golf bag for preventing entanglement of the golf clubs, wherein said base member defines a golf club receiving channel between the outer edges of said base member and the inner walls of the golf bag, and wherein said base member includes a top portion and a bottom portion each having side walls, wherein the side walls of said top and bottom portions extend upwardly from the bottom of the golf bag and inwardly at an angle, wherein the angle of said side walls of said top portion is less than the angle of said side walls of said bottom portion.

9. The golf club organizer for a golf bag of claim 8, wherein said retaining ring is constructed from a resilient material.

10. The golf club organizer for a golf bag of claim 8, wherein said retaining ring is constructed from a unitary material.

11. The golf club organizer for a golf bag of claim 8, wherein said golf club shaft retaining ring is constructed from a material selected from the group consisting of: rubber, foam rubber, styrofoam, and lightweight plastic.

12. The golf club organizer for a golf bag of claim 8, wherein said shaft receiving slot is greater than one-half inch in length.

13. The golf club organizer for a golf bag of claim 8, wherein each of said first and second adjacent fingers extends at least as far laterally as it extends inwardly from the inner periphery of the golf club shaft retaining ring.

14. The golf club organizer for a golf bag of claim 8, wherein said shaft receiving slot has a width less than that of a golf club shaft for locking the golf club shaft into said shaft receiving chamber after insertion.

15. The golf club organizer for a golf bag of claim 8, further comprising a travel insert for providing additional stability to the golf clubs during travel, said travel insert including a block member adapted to fit snugly within the inner periphery of said shaft retaining ring.

16. A base member for preventing entanglement of golf clubs in a golf bag, said base member comprising:

a bottom portion for mounting onto the bottom of a golf bag, wherein said bottom portion includes at least three side walls which extend upwardly from the bottom of the golf bag and inwardly at an angle; and a top portion attached to said bottom portion, wherein said top portion has at least three side walls which extend upwardly from said bottom portion and inwardly at an angle;

wherein the angle of said side walls of said top portion is less than the angle of said side walls of said bottom portion.

17. The base member for preventing entanglement of golf clubs in a golf bag of claim 16, wherein said top and bottom portions are unitarily combined.

18. The base member for preventing entanglement of golf clubs in a golf bag of claim 16, wherein said base member is constructed from a material selected from the group consisting of: rubber, foam rubber, styrofoam, and light-weight plastic.

19. A travel insert for stabilizing golf clubs within a golf bag-during transport, said travel insert comprising:

a block member for insertion into the inner opening of a shaft retaining ring positioned within the club receiving opening of a golf bag;

wherein said block member comprises a resilient material; and wherein said block member is further shaped to snugly fit within the inner opening of the shaft retaining ring.

20. The travel insert of claim 19, further including an upper surface having one or more indentations to provide a means for a golfer to grip and remove said travel insert.

21. The travel insert of claim 19, further including a tapered peripheral edge to ensure snug insertion into the inner opening of the shaft retaining ring.

* * * * *